US007169057B2

(12) United States Patent
Wood et al.

(10) Patent No.: US 7,169,057 B2
(45) Date of Patent: Jan. 30, 2007

(54) HOLLOW AND METAL IRON GOLF CLUB HEADS

(75) Inventors: David A. Wood, Humble, TX (US); James A. Bode, Albany, GA (US)

(73) Assignee: MacGregor Golf Company, Albany, GA (US)

( * ) Notice: Subject to any disclaimer, the term of this patent is extended or adjusted under 35 U.S.C. 154(b) by 0 days.

(21) Appl. No.: 10/765,215

(22) Filed: Jan. 28, 2004

(65) Prior Publication Data

US 2005/0164802 A1 Jul. 28, 2005

(51) Int. Cl.
*A63B 53/00* (2006.01)
*A63B 53/04* (2006.01)

(52) U.S. Cl. ..... 473/290; 473/345; 473/349; 473/350; 473/342

(58) Field of Classification Search ..... 473/324–350, 473/290–291; D21/738–739
See application file for complete search history.

(56) References Cited

U.S. PATENT DOCUMENTS 4,398,965 A * 8/1983 Campau ..... 148/522
4,754,969 A * 7/1988 Kobayashi ..... 473/290
4,836,550 A * 6/1989 Kobayashi ..... 473/350
5,024,437 A * 6/1991 Anderson ..... 473/342
5,110,131 A * 5/1992 Long ..... 473/349
5,362,047 A * 11/1994 Shaw et al. ..... 473/291
5,405,136 A * 4/1995 Hardman ..... 473/342
5,913,735 A * 6/1999 Kenmi ..... 473/338
2004/0023730 A1* 2/2004 Nagai et al. ..... 473/345

* cited by examiner

*Primary Examiner*—Sebastiano Passaniti
(74) *Attorney, Agent, or Firm*—Buchanan, Ingersoll & Rooney PC

(57) ABSTRACT

An iron golf club head having a hollow interior. The iron golf club head is formed from a first casing and a second casing. The first casing includes the hosel and strike face, while the second casing includes the sole, the back side, and the topline of the iron golf club head. The second casing also includes two cavities, one of which forms the hollow interior of the iron golf club head when the first casing is welded to the second casing. The thickness and hardness of the first casing vary between the long and short iron golf club heads.

36 Claims, 12 Drawing Sheets

HOLLOW AND METAL IRON GOLF CLUB HEADS

FIELD OF THE INVENTION

The present invention relates to iron golf clubs and, more particularly, to hollow, metal iron golf clubs heads formed from casings.

DESCRIPTION OF THE RELATED ART

Many conventional iron golf club heads have various features, such as weighted inserts, that are intended to improve the feel of the iron or make the iron easier to hit. While such features are beneficial for some irons, they are often not beneficial for others. For example, the inclusion of a low, rearward weighted insert in an iron head is generally beneficial in the lower loft irons, but can detrimentally affect the feel of the high loft irons for advanced golfers. Hence, some conventional iron heads have features that vary across the lofts of iron sets. Unfortunately, varying features across irons sets complicates the manufacture and assembly of even the simplest of blade iron designs. These problems are even more pronounced when attempting to include such features in more advanced iron designs, such as hollow metal iron heads.

SUMMARY

In light of the above-described problems of some conventional iron golf club heads, some embodiments of the present invention generally strive to provide hollow metal "iron" type golf club heads that have features that vary across lofts in an iron set, yet are still relatively easy to manufacture. Additionally, some embodiments of the present invention generally strive to provide a construction for a hollow metal iron golf club head that has a center of gravity located more rearward than that of some conventional iron golf club heads.

Other advantages and features associated with the embodiments of the present invention will become more readily apparent to those skilled in the art from the following detailed description. As will be realized, the invention is capable of other and different embodiments, and its several details are capable of modification in various obvious aspects, all without departing from the invention. Accordingly, the drawings in the description are to be regarded as illustrative in nature, and not limitative.

DETAILED DESCRIPTION OF PREFERRED EMBODIMENTS

Figure 1:
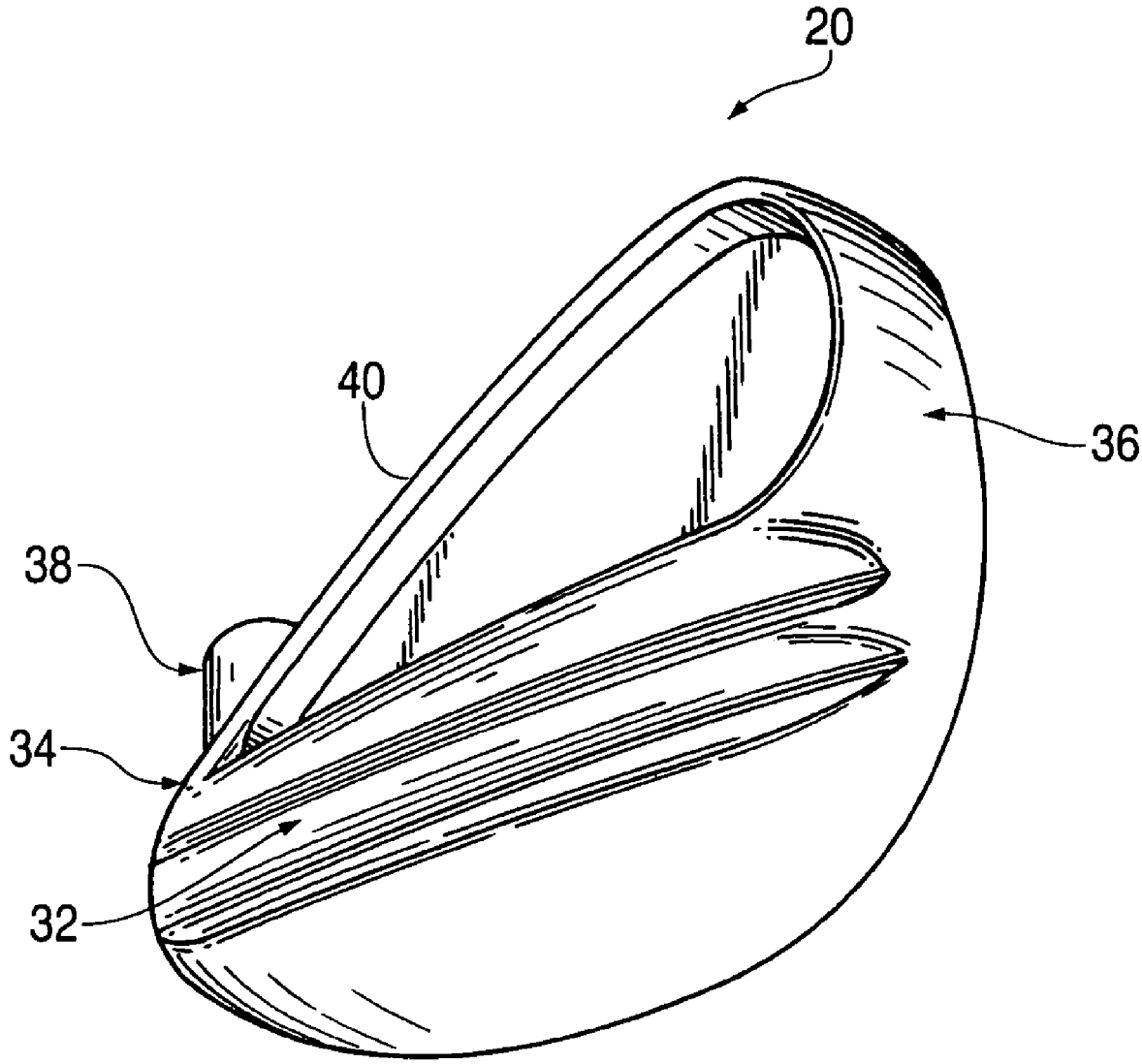
FIG. 1 is back perspective view of an iron type golf club head in accordance with a first embodiment of the present invention.

FIGS. 1–12 illustrate one embodiment of a "iron" type golf club head 20 in accordance with the present invention. The illustrated iron golf club head 20 is a six iron head having a loft of 29° and is attached to a golf shaft (not illustrated) to form an assembled golf club (not illustrated). The iron golf club head 20 has a front strike face 22 that strikes a golf ball when a golfer swings the club. The strike face 22 includes a periphery defined by a top edge 24, a bottom edge 26, a toe edge 28, and a heel edge 30. The golf club head 20 also includes a back side 32 located opposite from the front strike face 22 and that defines the trailing edge of the club head 20 when a golfer swings the club. The iron golf club head 20 also includes a heel 34, a toe 36 located opposite from the heel, and a hosel 38 that receives the shaft of the golf club. The golf club head 20 further includes a top line 40 that defines the top of the golf club head, and a sole 42 located opposite from the crown. The sole 42 adjoins the bottom edge 26 of the strike face 22 and extends rearward in a direction toward the back side 32 until it adjoins the back side, and also extends in a direction toward the heel 34 and toe 36.

Figure 8:
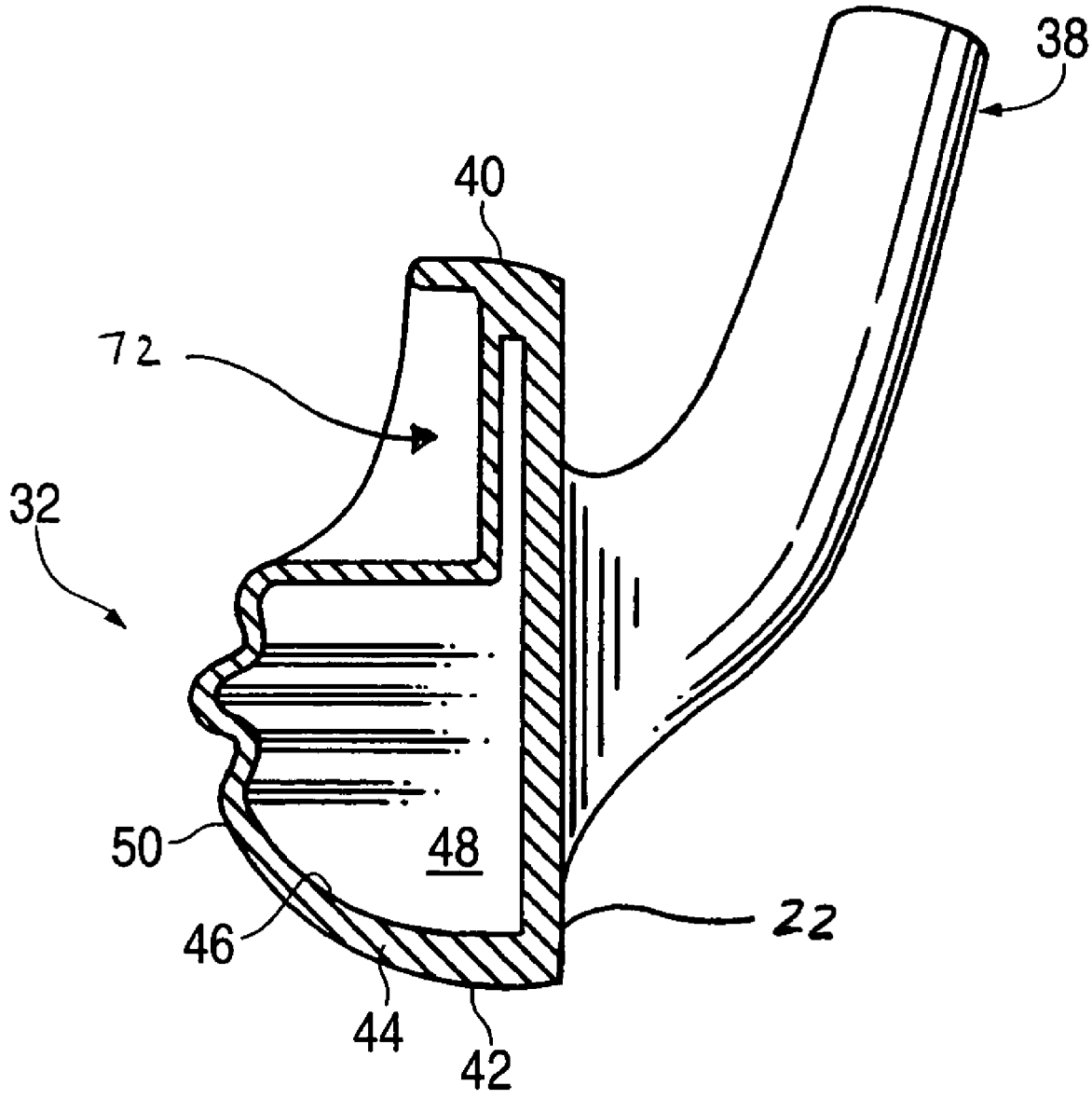
FIG. 8 is a cross sectional view of the golf club head illustrated in FIG. 1, taken along the line 8—8 in FIG. 6.

As illustrated in FIG. 8, the iron golf club head 20 has a hollow body defined by a metallic wall 44. The metallic wall 44 defines the perimeter of the iron golf club head 20. In this manner, the iron golf club head 20 is perimeter weighted. The metallic wall 44 includes an interior surface 46 that faces an interior 48 of the iron golf club head 20. The metallic wall 44 also includes an exterior surface 50 that faces an exterior of the golf club head 22. In the preferred embodiment, the hollow interior 48 of the iron golf club head 20 is empty, having no material therein except for a gas, such as air. However, in alternative embodiments of the iron golf club head 20, the hollow interior 48 may be filled with a substance such as foam and/or may include reinforcement bars or ridges therein.

Figure 9:
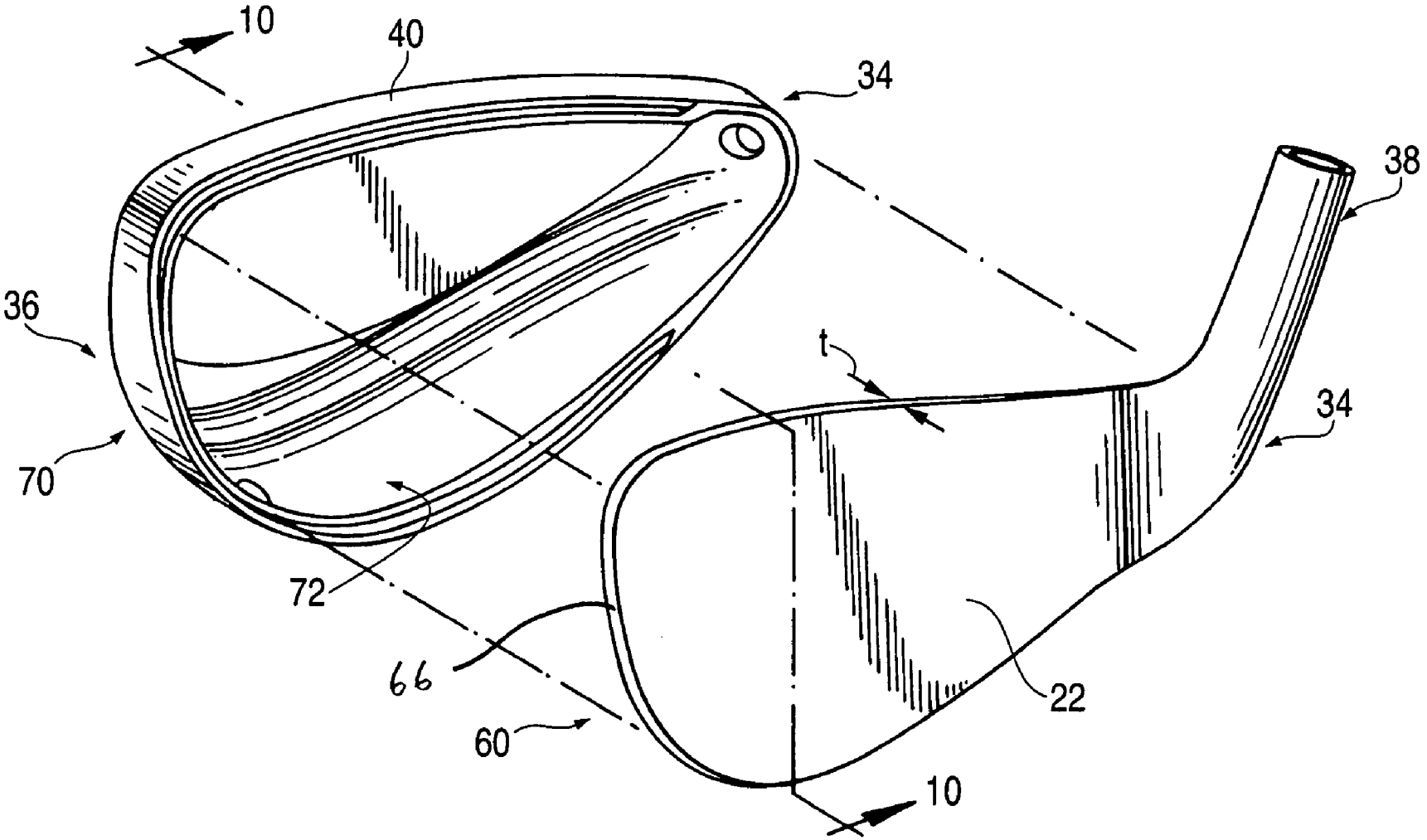
FIG. 9 is an exploded assembly view the golf club head illustrated in FIG. 1.

As is illustrated in FIGS. 9–12, the iron golf club head 20 is formed from two separate metal casings 60, 70, which are formed metal objects that together define the body of the iron golf club head 20 as described below. The first casing 60 includes the hosel 38 and strike face 22, while the second casing 70 includes the sole 42, back side 32, top line 40, and toe 36. As is illustrated in FIG. 9, the first casing 60 and the second casing 70 each include a portion of the heel 34 of the iron golf club head 20. In an alternative embodiment, the second casing 70 does not include any portion of the heel 34 and/or the toe 36, or only a portion of the heel and/or the toe. For example, the heel 34 and/or the toe 36, or a portion thereof, can be formed in the first casing 60.

Figure 10:
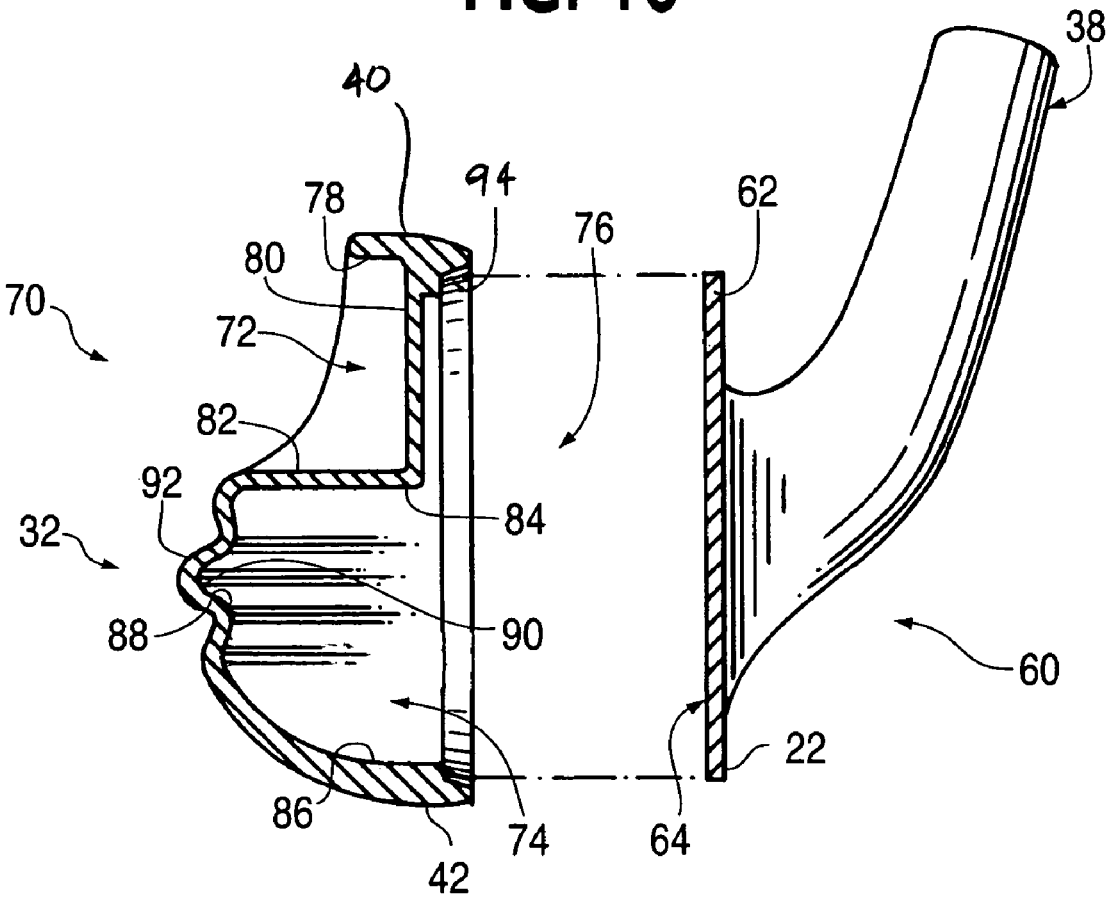
FIG. 10 is an exploded cross sectional view of the golf club head illustrated in FIG. 8, taken along the line 10—10 in FIG. 9.

As is best illustrated in FIGS. 9 and 10, the second casing 70 of the iron golf club head 20 includes two cavities 72, 74 that are each defined by the contour of the metal wall 44 of the second casing 70. The first cavity 72 is a recess or hollow in the casing 70 as viewed from the back side 32 of the casing and is recessed with respect to the most rearward edge of the topline 40. The second cavity 74 is a recess or hollow in the casing 70 as viewed from a front side 76 of the casing opposite from the back side 32 and is recessed with respect to the most forward edge of the sole 42. As is apparent from FIGS. 9–11, each cavity 72, 74 generally extends in a direction from the heel 34 to the toe 36 at the back side 32, i.e., generally horizontally across the back side of the 32 of the iron golf club head 20 when the iron golf club head is at the address position. Additionally, each cavity 72, 74 is elongated, having a length measured in a direction from the heel 34 to the toe 36 that is greater than a width measured in a direction normal to the direction from the heel 34 to the toe 36.

Figure 2:
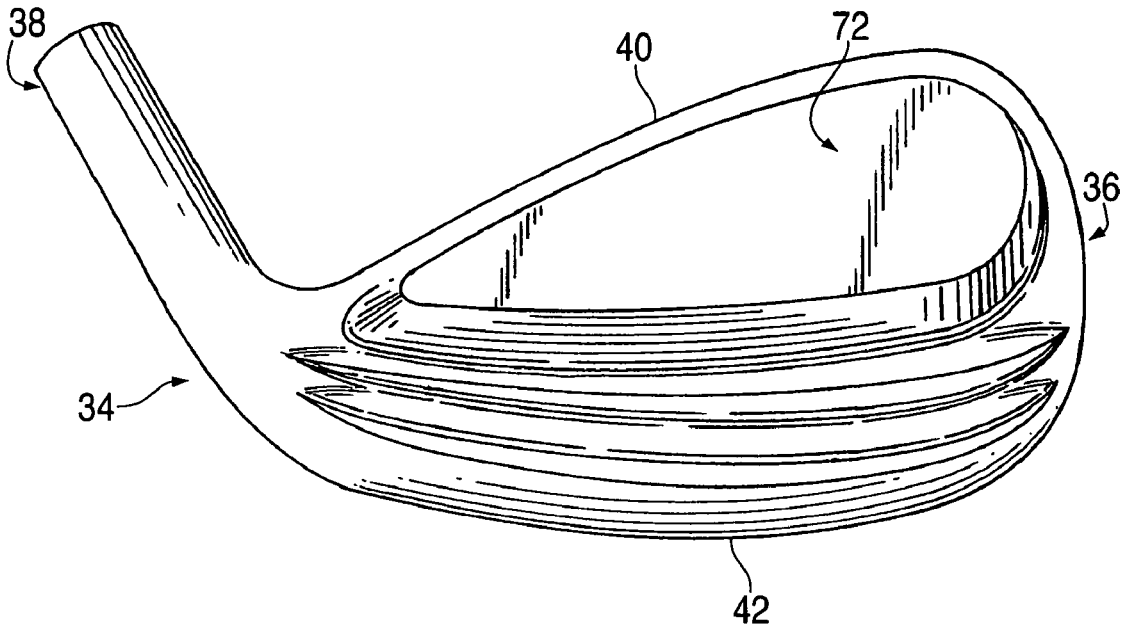
FIG. 2 is a back elevational view of the golf club head illustrated in FIG. 1.
Figure 3:
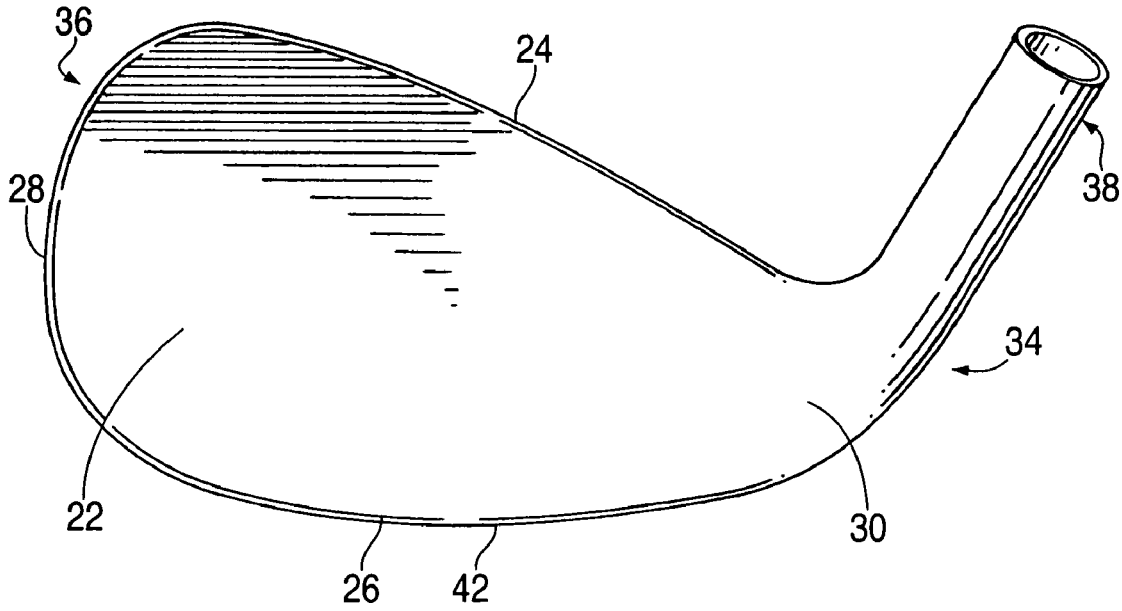
FIG. 3 is a front elevational view of the golf club head illustrated in FIG. 1.
Figure 4:
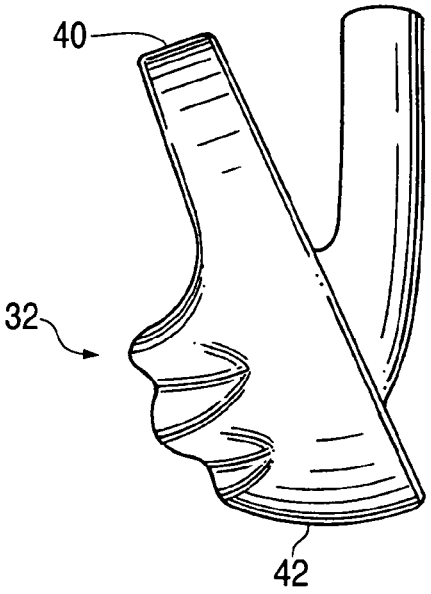
FIG. 4 is a toe side elevational view of the golf club head illustrated in FIG. 1.
Figure 5:
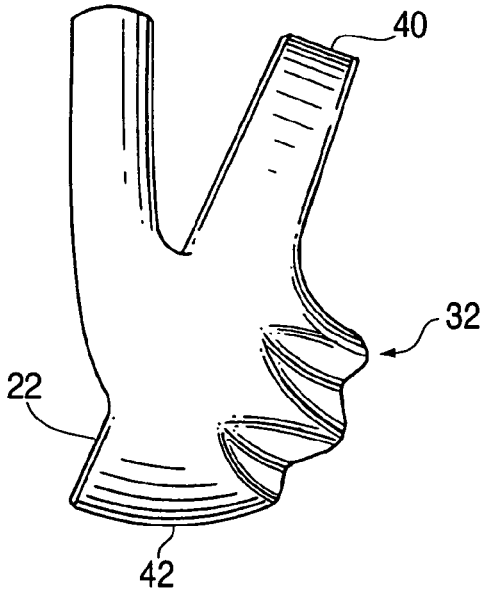
FIG. 5 is a heel side elevational view of the golf club head illustrated in FIG. 1.
Figure 6:
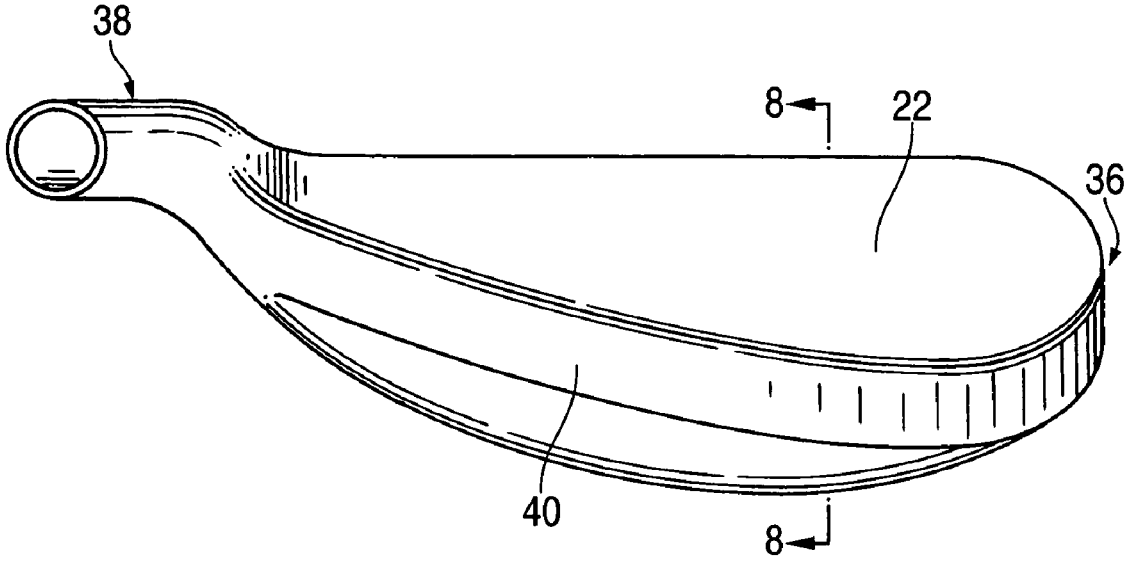
FIG. 6 is a top plan view of the golf club head illustrated in FIG. 1.
Figure 7:
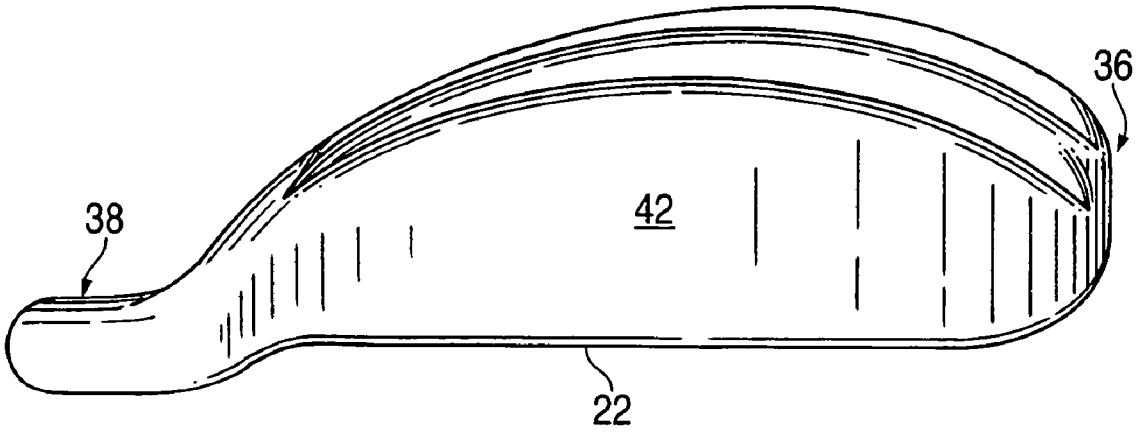
FIG. 7 is a sole or bottom plan view of the golf club head illustrated in FIG. 1.

As is illustrated in FIGS. 1 and 2, the profile or periphery of the first cavity 72 is an elongated teardrop. However, other shapes are contemplated. For example, the first cavity 72 may have a profile in the shape of an ellipse. In reference to FIG. 10, an upper, interior surface 78 of the first cavity 72 is defined by a portion of the metallic wall 44 that also defines the top line 40 of the iron golf club head 20. A lower, interior surface 82 of the first cavity 72 is defined by a portion of the metallic wall 44 that also defines an upper, interior surface 84 of the second cavity 74; this portion of the metallic wall 44 is substantially normal to the strike face 22. Hence, one portion of the wall defines a side 82 of the first cavity 22 and a side 84 of the second cavity 74. An inner-most surface 80 of the first cavity 72 is preferably entirely planar, but may be contoured and have surface features in other embodiments. In the illustrated embodiment, the first cavity 72 has a volume of approximately 5 cubic centimeters and the inner most surface 80 is approximately 2 cm from a most reward point of the back side 32.

Figure 11:
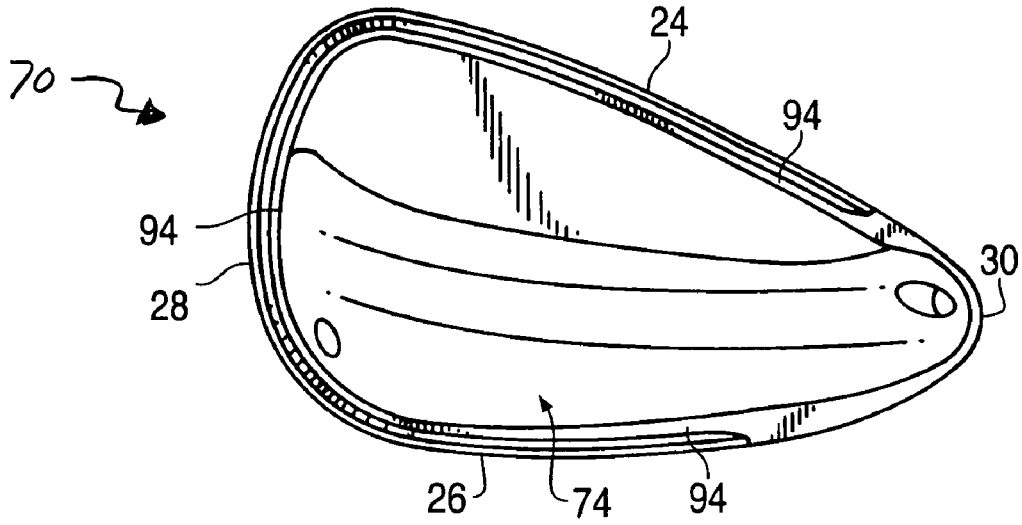
FIG. 11 is a front view of the back casing illustrated in FIG. 9.
Figure 12:
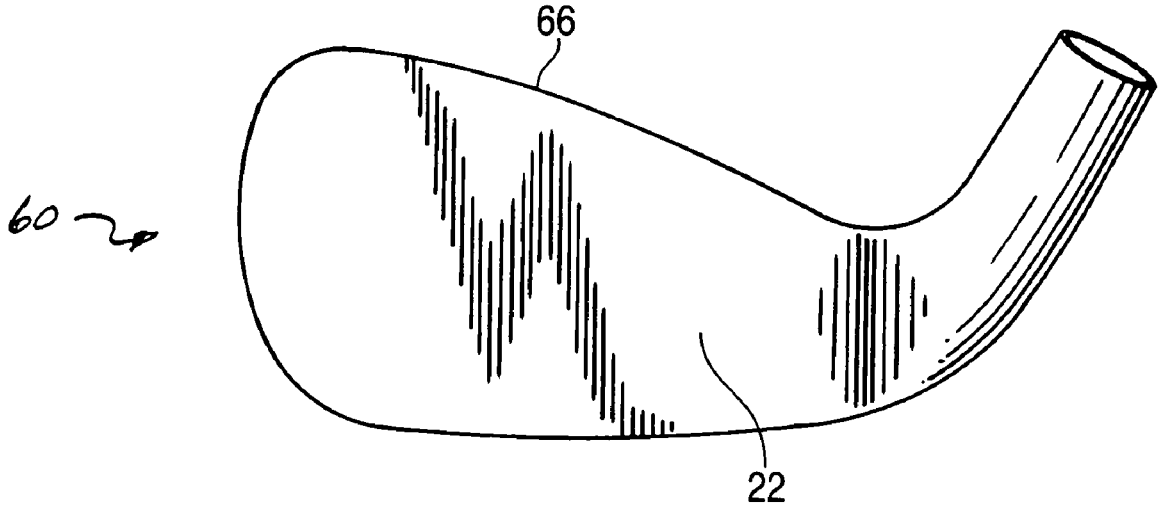
FIG. 12 is a front view of the face casing illustrated in FIG. 9.

As is illustrated in FIGS. 9 and 11, the second cavity 74 has a generally curvilinear profile that narrows toward the heel 34 and widens toward the toe 36. However, other shapes are contemplated. For example, the second cavity may have a triangular profile. In reference to FIG. 10, a lower, interior surface 86 of the second cavity 74 is defined by a portion of the metallic wall 44 that also defines the sole 42 of the iron golf club head 22. An inner-most surface 88 of the first cavity 72 is preferably curvilinear. Additionally, the inner-most surface 88 includes an elongated indentation 90, which is defined by the metallic wall 44 and appears as a bulbous protrusion 92 when viewed from the back side 32. In alternative embodiments, the second cavity 74 of the second casing 70 does not include the elongated indentation 90 and bulbous protrusion 92. For example, the inner most surface 88 may be entirely smooth or be planar in alternative embodiments. Additionally, the second cavity 74 may have other contours and/or other surface features in other embodiments. In the illustrated embodiment, the second cavity 74 has a volume of approximately 30 cubic centimeters and the inner most surface 88 is approximately 2.3 cm from a most forward point of the front side 76.

The second cavity 74 is the lower of the two cavities 72, 74 when the iron golf club 22 head is at the address position. That is, a majority of the second cavity 74 is nearer the sole 42 than a majority of the first cavity 72. Hence, the first cavity 72 is located above the second cavity 74 as measured with respect to the sole 42. As is apparent from FIGS. 8 and 10, the first cavity 72 generally moves the perimeter weight of the upper half of the metallic wall 44 toward the face 22 as opposed to away from the face, which would be the case had the cavity 72 not been included in the second casing. In contrast, the second cavity 74 creates more surface area and weight so as to generally move the perimeter weight of the lower half of the metallic way 44 away from the face 22 as opposed to near the face. Hence, the first and second cavities 72, 74 of the second casing 70 have the beneficial effect of moving the center of gravity farther back, deeper in the hollow golf club head 20, as compared to some conventional iron golf club heads, such as a solid blade design. In this manner, the iron golf club head 20 advantageously has a simple, hollow construction, but with a deep center of gravity. To illustrate this effect, the applicants measured: (1) the center of gravity of three differently lofted clubs having a construction identical to that described above (in the case of a six iron) or nearly identical (in the case of a five and seven iron); and (2) the center of gravity of three differently lofted clubs (five through seven irons) having a conventional solid blade design. The five iron according to an embodiment of the present invention had a center of gravity that was 0.138 inches farther away from the club face than the conventional five iron. The six iron according to an embodiment of the present invention had a center of gravity that was 0.100 inches farther away from the club face than the conventional six iron. Likewise, the seven iron according to an embodiment of the present invention had a center of gravity that was 0.103 inches farther away from the club face than the conventional seven iron. This effect was even more pronounced in the longer irons. Hence, the construction of the iron golf club head 20 helps locate the center of gravity deeper in the club head.

Referring again to FIGS. 8 and 10, the second casing 70 includes a continuous lip or beveled edge 94 that receives the first casing 60. The edge 94 generally follows the shape of and is directly adjacent to the periphery of the strike face 22 defined by the top edge 24, the bottom edge 26, the toe edge 28, and the heel edge 30. The first casing 60 has a planar metal wall 62, a leading face of which defines the strike face 22 of the iron golf club head 20. The wall 62 also has a trailing or back face 64 located opposite from the strike face 22. The wall 62 has a periphery 66 that closely matches or mates that of the edge 94. Hence, as is illustrated by FIGS. 8 and 10, to assemble the iron golf club head 20, the periphery 66 of the wall 62 is located on the edge 94. Then, the casings 60, 70 are welded together at the interface between the edge 94 and the periphery 66 to define the unitary, hollow iron golf club head illustrated in FIG. 8. Hence, the front casing 60 is welded to the second casing 70 such that the second cavity 74 defines the hollow interior 48 of the iron golf club head 20.

As is illustrated in FIG. 8, in the preferred embodiment, the portion of the metallic wall 44 of the second casing 70 that defines the inner most surface of the first cavity 72 preferably does not contact the trailing surface 64 of the first casing 60. This is because the interface between the first cavity 72 and the second cavity 74 is roughly behind the sweet spot of the iron golf club head 20 and a connection or attachment between the first and second casings at this location could adversely affect the performance or feel of the club head. Additionally, the portion of the metallic wall 44 of the second casing 70 that defines the inner most surface 80 of the first cavity 72 structurally supports the top line 40, which is defined by of the second casing. However, in an alternative embodiment, the portion of the metallic wall 44 of the second casing 70 that defines the inner most surface 80 of the first cavity 72 contacts the trailing surface 64 of the first casing 60. In one embodiment the first casing 60 is welded to the second casing 70 at this location.

The planar metal wall 62 of the first casing 60 has an average wall thickness T, which is the average of the specific thickness t of the wall as measured at each square centimeter location on the strike face 22. In an embodiment where the iron golf club head 20 is a long iron having a loft less than 33° (iron numbers one through six), the average wall thickness T is less than 3.0 mm, preferably being approximately 2.5 mm. In an embodiment where the iron golf club head 20 is a short iron having a loft of at least 33° (iron numbers seven through nine, pitching wedge, and sand wedge), the average wall thickness T is greater than 2.0 mm, preferably greater than 2.5 mm. In one preferred set of golf club irons: (1) the average wall thickness T for longs iron golf club heads (having a loft less than 33°) is approximately 2.5 mm; (2) the average wall thickness T for a seven iron is approximately 2.5 mm; (3) the average wall thickness T for an eight iron is approximately 2.85 mm; and (4) the average wall thickness T for each of a nine iron, a pitching wedge iron, and a sand wedge iron is approximately 3.5 mm. Hence, in accordance with some embodiments of the present invention, the average wall thickness T of the wall 62 changes between the long and the short irons. This is beneficial because a thinner face on the longer, hollow irons heads helps locate the center of gravity farther back in the iron face, while a thicker face in the shorter irons improves feel. In a preferred embodiment, except for slight variations due to forging, the specific thickness t is relatively uniform across an entirety of the planar wall 62. Hence, in the preferred embodiment, the specific thickness t typically equals the average thickness T.

The first casing 60 and the second casing 70 may be formed from the same metal or may be formed from different metals. For example, in one embodiment the first casing 60 is formed from a carbon steel, such as 1045, while the second casing is formed from a second steel, such as 1025, 1030, 304, and 314. In another embodiment, the first casing and the second casing are formed from the same carbon steel, such as a maraging steel. In a preferred embodiment of a long iron head, the first casing 60 is formed from 455 steel and the second casing is formed from 1045 steel. In a preferred embodiment of a short iron head, the first casing and the second casing are 60 formed from 1045 steel.

The strike face 22 of the first casing 60 has an average hardness H, which is the average of the specific hardnesses h of the strike face as measured at each square centimeter location on the strike face. In a preferred embodiment of a set of iron golf clubs heads according to embodiments of the present invention, the iron golf club heads that are long irons (having a loft less than 33°, i.e., irons one through six) have a strike face 22 with an average hardness H that is greater than that of the strike face of the iron golf club heads that are short irons (having a loft of at least 33°, i.e., irons seven through nine, pitching wedge, and sand wedge). More preferably, in an embodiment where the iron golf club head 20 is a long iron, the average hardness H is between HRC25–42, preferably between HRC25–35. In the embodiment in which the iron golf club 20 is a long iron, the specific hardness will vary across the strike 22 face because the center of the face is heat treated. Specifically, the center will have a hardness of approximately HRC35, while the edge of the strike face will have a hardness of about HRC25, in which case the average hardness H is between HRC25–35. In an embodiment where the golf club iron 20 is a short iron, the average hardness H is between HRB80–HRC20, preferably being approximately HRC10. In the embodiment in which the iron golf club 20 is a short iron, the center of the face is not heat treated such that specific hardness h at each square centimeter location will approximately equal the average hardness H. Hence, in accordance with some embodiments of the present invention, the average hardness H of the strike face 22 changes between the long and the short irons. This is beneficial because a harder face on the longer, hollow irons allows the face to be thinner, which helps locate the center of gravity farther back in the long irons, while a softer face in the shorter irons improves the feel of these irons, as is preferred by many golfers. The above-described variations in the average hardness H of the strike face 22 between the long and short irons heads can be realized in different embodiments of the present invention by forming the first and second casings 60, 70 from different materials, by heat treating different or the same materials, or by selecting different materials for the respective first casings 60 of the long and short irons. In a particularly preferred embodiment, the above-described variations in the hardness between the long and short irons heads is achieved by forming the first casing 60 of the long irons from 455 steel, where the center of the strike face 22 has been heat treated to 25–42 HRC, and by forming the first casing 60 of the short irons from a softer carbon steel, namely 1045 steel without a heat treatment.

The first casing 60 and the second casing 70 may be formed by many different fabrication processes in accordance with embodiments of the present invention. For example, in one embodiment, the first casing 60 and the second casing 70 are both cast. In another embodiment, the first casing 60 and the second casing 70 are both forged. In another embodiment, the first casing 60 is forged and the second casing 70 is machined. In the preferred embodiment, the first casing 60 is forged and the second casing 70 is cast.

FIGS. 13–16 illustrate iron golf club heads 120, 220 in accordance with alternative embodiments of the present invention. The foregoing discussion of the benefits and functions of the iron golf club head 20 also applies to the iron golf club heads 120, 220. Thus, the iron golf club heads 120, 220 illustrated in FIGS. 13–16 have been assigned corresponding reference numbers as the iron golf club head 20, increased by hundreds. The iron golf club heads 120, 220 illustrated in FIGS. 13–16 also include additional features and inherent functions, as described further below.

Figure 13:
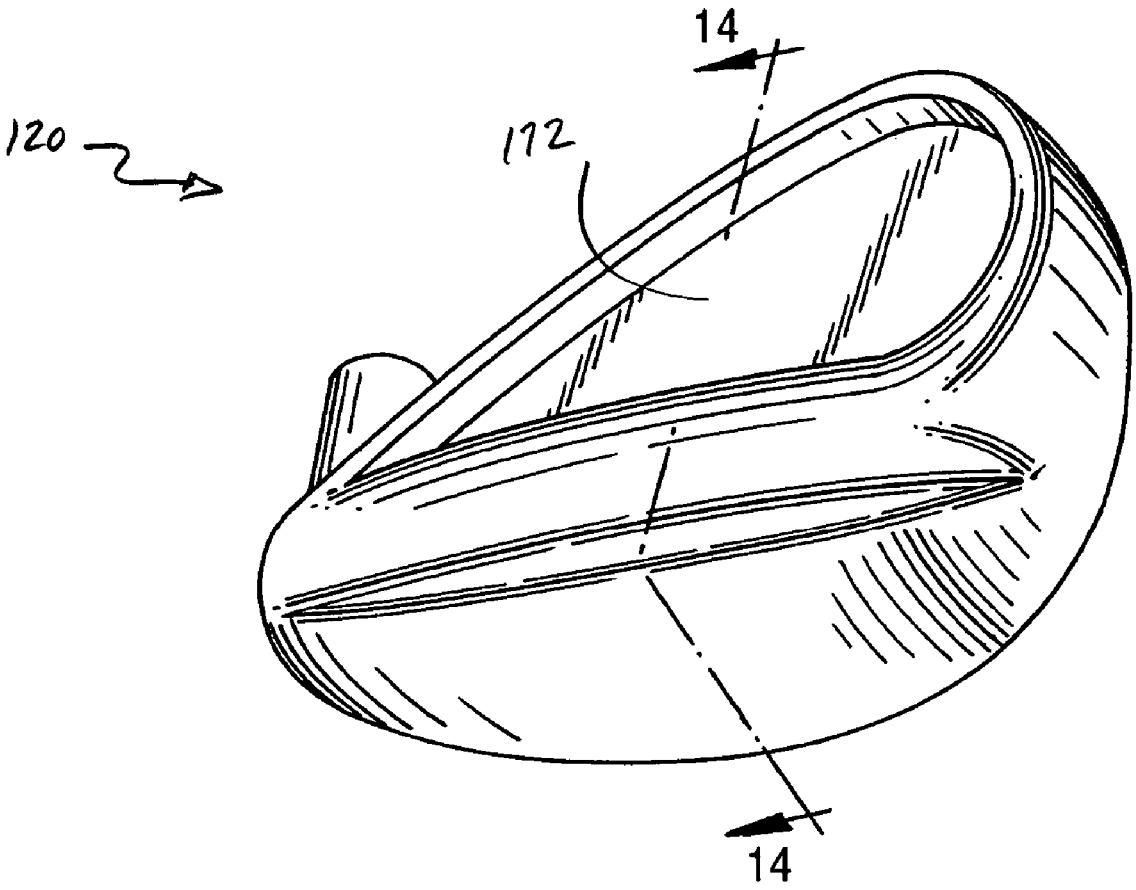
FIG. 13 is a back perspective view of an iron type golf club head in accordance with a second embodiment of the present invention.
Figure 14:
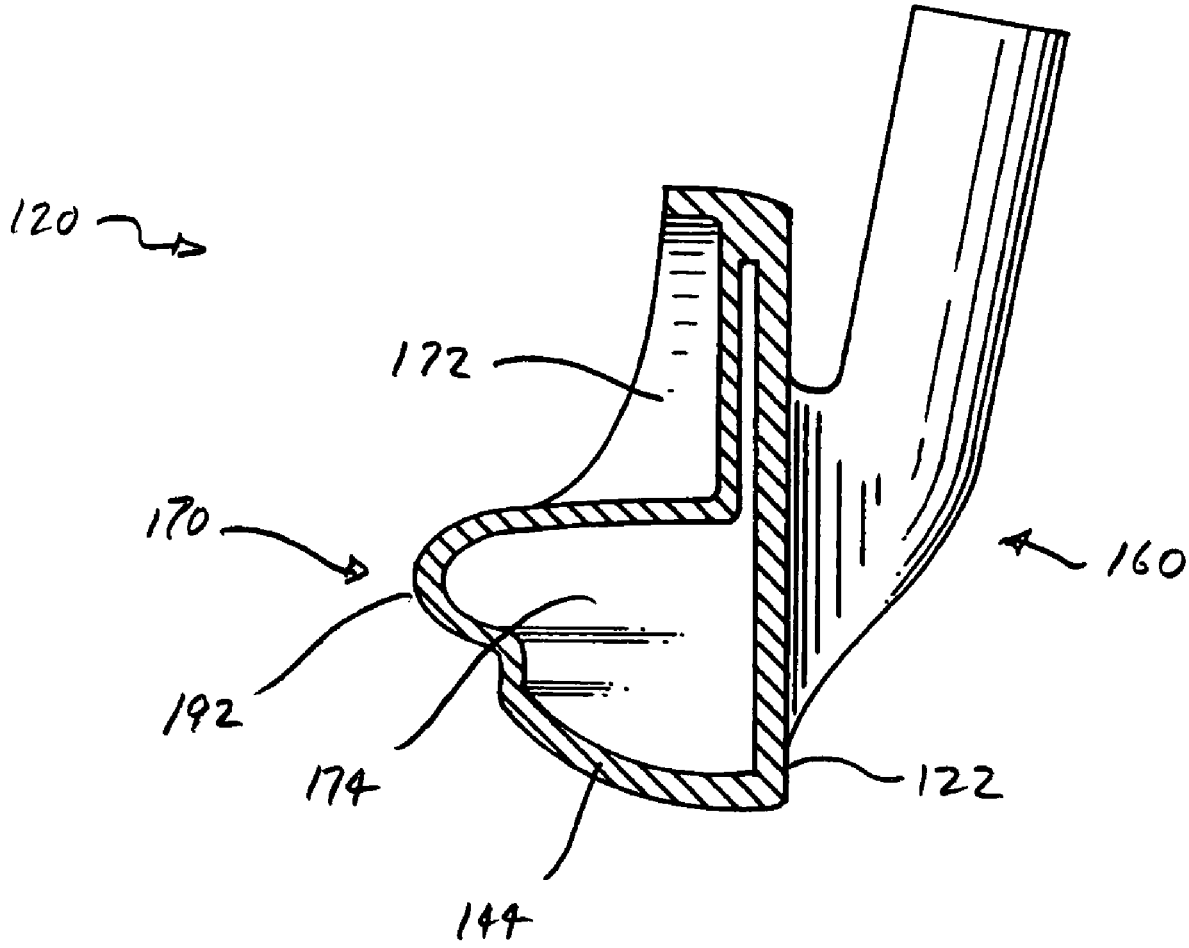
FIG. 14 is a cross sectional view of the golf club head illustrated in FIG. 1, taken along the line 14—14 in FIG. 13.

Except for a few areas set forth below, the iron golf club head 120 illustrated in FIGS. 13 and 14 is identical to the iron golf club head 20. Hence, the iron golf club head 120 includes a first casing 160 that is welded to a second casing 170. The first casing 160 is identical to the casing 60, except that it has a loft of a three iron, namely 20°. The second casing 170 is nearly identical to the casing 70, except that the metallic wall 144 has a different contour. As is illustrated in FIG. 14, the contour of the metal wall 144 defines the first and second cavities 172, 174, but the bulbous protrusion 192 of the second cavity 174 is more pronounced, i.e., larger than the bulbous protrusion 92 of the second cavity 74. Additionally, the bulbous protrusion 192 of the second cavity 174 is deeper that that of the second casing 70. That is, the bulbous protrusion 192 of the second cavity 174 is farther back or more trailing from the strike face 122 than the second cavity 70 is with respect to the strike face 22.

Figure 15:
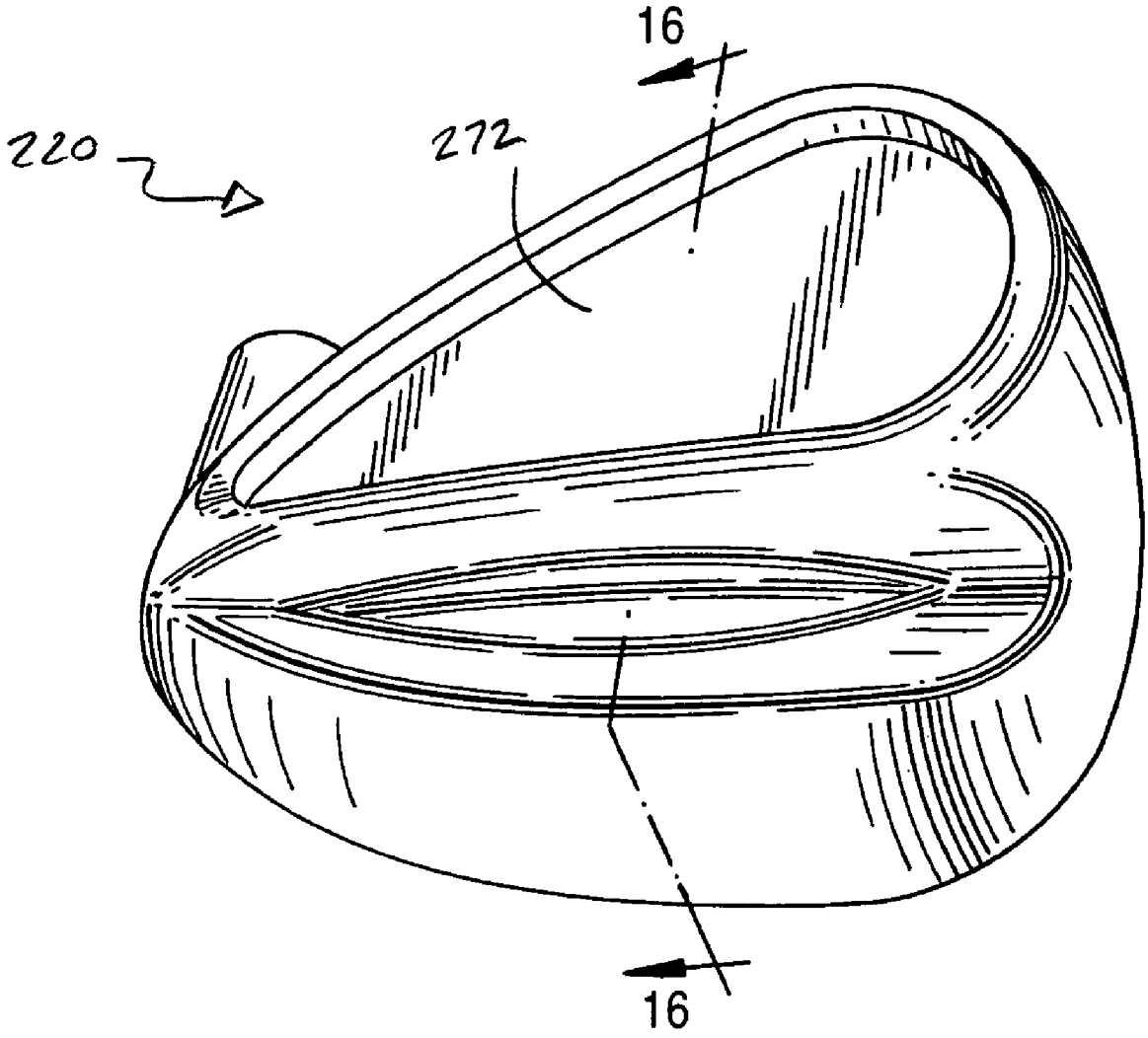
FIG. 15 is back perspective view of an iron type golf club head in accordance with a third embodiment of the present invention.
Figure 16:
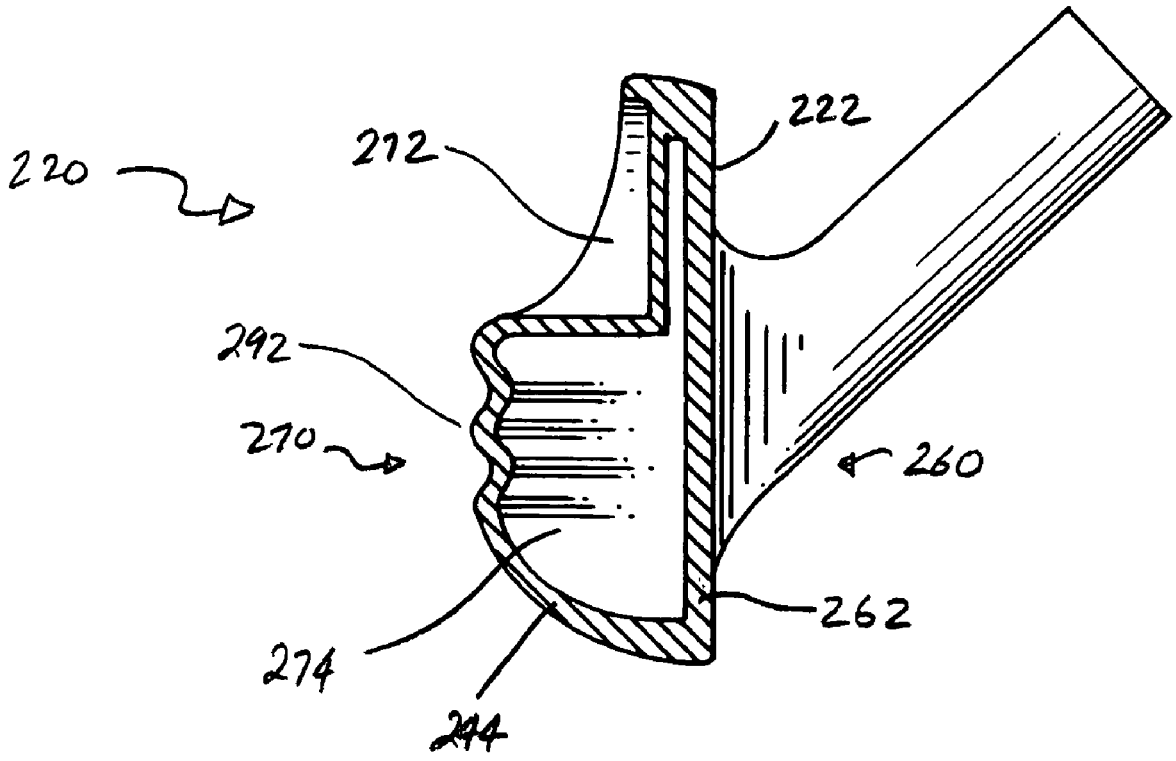
FIG. 16 is a cross sectional view of the golf club head illustrated in FIG. 1, taken along the line 16—16 in FIG. 15.

Except for a few areas set forth below, the an iron golf club head 220 illustrated in FIGS. 15 and 16 is identical to the iron golf club head 20. Hence, the iron golf club head 220 includes a first casing 260 that is welded to a second casing 270. The first casing 260 is identical to the casing 60, except that it has a loft of a nine iron, namely 41°. Additionally, the average thickness T of the planar wall 262 is thicker than the average thickness T of the planar wall 62 of the first casing 60. More specifically, the average thickness T of the planar wall 262 is 3.5 mm, while the average thickness T of the planar wall 62 is 2.5 mm. As described above, this increased thickness provides better feel in this short iron golf club head. The first casing 260 is also formed from 445 steel that has been heat treated at the center of the strike face 222, whereas the first casing 60 steel is formed 1045 steel, with no heat treatment. Hence, the strike face 222 of the first casing 260 has an average hardness of HRC25–42, while the strike face 22 of the first casing 60 has an average hardness H of HRB80–HRC20. The second casing 270 is nearly identical to the casing 70, except that the metallic wall 244 has a different contour. As is illustrated in FIG. 16, the contour of the metal wall 244 defines a first and second cavities 272, 274, but the bulbous protrusion 292 of the second cavity 274 is less pronounced and not as elongated as the bulbous protrusion 92 of the second cavity 74.

The principles, preferred embodiments, and modes of operation of the present invention have been described in the foregoing description. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

The invention claimed is:

1. Iron golf club heads, comprising:

a long metal iron head having a hollow interior, a strike face, a hosel, a sole, a back side, a top line, a toe, a heel, and a loft less than 33 °, said long metal iron head being formed from a first casing and a second casing, said first casing having said hosel and said strike face, said strike face having an average wall thickness, said second casing having said sole, said back side, said top line, a front side located opposite from said back side, and a cavity as viewed from a direction facing said front side, said first casing being welded to said second casing such that said cavity defines at least a portion of said hollow interior; and a short metal iron head having a hollow interior, a strike face, a hosel, a sole, a back side, a top line, a toe, a heel, and a loft of at least 33 °, said short metal iron head being formed from a third casing and a fourth casing, said third casing having said hosel and said strike face of said short metal iron head, said strike face of said short metal iron having an average wall thickness, said fourth casing having said sole, said back side, and said top line of said short metal iron head, said fourth casing having a front side located opposite from said back side of said fourth casing, said fourth casing having a cavity as viewed from a direction facing said front side of said fourth casing, said third casing being welded to said fourth casing such that said cavity of said fourth casing defines at least a portion of said hollow interior of said short metal iron head, said strike face of said short metal iron head having a substantially uniform wall thickness across an entirety of said strike face of said short metal iron head, said strike face of said long metal iron head having a substantially uniform wall thickness across an entirety of said strike face of said long metal iron, said average wall thickness of said strike face of said long metal iron head being less than said average wall thickness of said strike face of said short metal iron head.

2. The iron golf club heads of claim 1, said average wall thickness of said strike face of said long metal iron head being less than 3 mm.

3. The iron golf club heads of claim 1, said average wall thickness of said strike face of said long metal iron head being approximately 2.5 mm.

4. The iron golf club heads of claim 1, said average wall thickness of said strike face of said short metal iron head being greater than 2 mm.

5. The iron golf club heads of claim 1, said average wall thickness of said strike face of said short metal iron head being greater than 2.5 mm.

6. The iron golf club heads of claim 1, said average wall thickness of said strike face of said short metal iron head being greater than 3.0 mm.

7. The iron golf club heads of claim 1, said average wall thickness of said strike face of said short metal iron head being approximately 2.85 mm.

8. The iron golf club heads of claim 1, said average wall thickness of said strike face of said short metal iron head being approximately 3.5 mm.

9. The iron golf club heads of claim 1, said average wall thickness of said strike face of said long metal iron head being 2.5 mm or less, said average wall thickness of said strike face of said short metal iron head being greater than 2.5 mm.

10. The iron golf club heads of claim 1, said first casing and said third casing each being a forged casing, said second casing and said fourth casing each being a cast casing.

11. The iron golf club heads of claim 1, said first casing being formed from a first steel, said third casing being formed from a second steel.

12. The iron golf club heads of claim 1, said strike face of said first casing having an average hardness between HRC25–42, said strike face of said third casing having an average hardness between HRB80–HRC20.

13. The iron golf club head of claim 1, wherein said cavity of said second casing is one cavity and the second casing comprises another cavity as viewed from a direction facing said back side, said one cavity and said another cavity each being elongated and each generally extending in a direction from said heel to said toe, said another cavity being located above said one cavity as measured with respect to said sole.

14. The iron golf club head of claim 1, wherein said cavity of said fourth casing is one cavity and the fourth casing comprises another cavity as viewed from a direction facing said back side, said one cavity and said another cavity each being elongated and each generally extending in a direction from said heel to said toe, said another cavity being located above said one cavity as measured with respect to said sole.

15. Iron golf club heads, comprising: a long metal iron head having a hollow interior, a strike face, a hosel, a sole, a back side, a top line, a toe, a heel, and a loft less than 33°, said long metal iron head being formed from a first casing and a second casing, said first casing having said hosel and said strike face, aid strike face having an average hardness, aid second casing having said sole, said back side, said top line, a front side located opposite from said back side, and a cavity as viewed from a direction facing said front side, said first casing being welded to said second casing such that said cavity defines at least a portion of said hollow interior; and a short metal iron head having a hollow interior, a strike face, a hosel, a sole, a back side, a top line, and a loft of at least 33°, said short metal iron head being formed from a third casing and a fourth casing, said third casing having said hosel and said strike face of said short metal iron head, said strike face of said short metal iron having an average hardness, said fourth casing having said sole, said back side, said top line, said toe, and said heel of said short metal iron head, said fourth casing having a front side located opposite from said back side of said fourth casing, said fourth casing having a cavity as viewed from a direction facing said front side of said fourth casing, said third casing being welded to said fourth casing such that said cavity of said fourth casing defines at least a portion of said hollow interior of said short metal iron head, said average hardness of said strike face of said long metal iron being greater than said average hardness of said strike face of said short metal iron.

16. The iron golf club heads of claim 15, said average hardness of said strike face of said long metal iron head being between HRC25–42.

17. The iron golf club heads of claim 15, said average hardness of said strike face of said short metal iron head being between HRB80–HRC20.

18. The iron golf club heads of claim 15, said average hardness of said strike face of said long metal iron head being between HRC25–42, said average hardness of said strike face of said short metal iron head being between HRB80–HRC20.

19. The iron golf club heads of claim 15, said first casing and said third casing each being a forged casing, said second casing and said fourth casing each being a cast casing.

20. The iron golf club heads of claim 15, said first casing being formed from a first steel, said third casing being formed from a second steel that is different than said first steel.

21. The iron golf club head of claim 15, wherein said cavity of said second casing is one cavity and the second casing comprises another cavity as viewed from a direction facing said back side, said one cavity and said another cavity each being elongated and each generally extending in a direction from said heel to said toe, said another cavity being located above said one cavity as measured with respect to said sole.

22. The iron golf club head of claim 15, wherein said cavity of said fourth casing is one cavity and the fourth casing comprises another cavity as viewed from a direction facing said back side, said one cavity and said another cavity each being elongated and each generally extending in a direction from said heel to said toe, said another cavity being located above said one cavity as measured with respect to said sole.

23. An iron golf club head having a hollow interior, a strike face, a hosel, a sole, a back side, a top line, a toe, and a heel, said iron golf club head comprising:

a first metal casing having said hosel and said strike face; and a second metal casing having a metallic wall that defines said sole, said back side, said top line, and a front side located opposite from said back side, said second casing having a first cavity as viewed from a direction facing said back side, said second casing having a second cavity as viewed from a direction facing said front side, said first cavity and said second cavity each being elongated and each generally extending in a direction from said heel to said toe, said first cavity being located above said second cavity as measured with respect to said sole, said first casing being welded to said second casing such that said second cavity defines at least a portion of said hollow interior of said iron golf club head.

24. The iron golf club head of claim 23, one portion of said metallic wall being substantially normal to said strike face and defining both a side of said first cavity and a side of said second cavity.

25. The iron golf club head of claim 24, said side of said first cavity being a first side, another portion of said metallic wall defining both said sole and a second side of said second cavity located opposite from said first side.

26. The iron golf club head of claim 24, said side of said second cavity being a first side of said second cavity, another portion of said metallic wall defining both said top line and a second side of said second cavity located opposite from said first side of said second cavity.

27. The iron golf club head of claim 23, said metallic wall defining a planar surface at an innermost location within said first cavity.

28. The iron golf club head of claim 23, said first casing having a planar wall that defines said strike face, said planar wall having a periphery, said second casing having an edge that receives said periphery.

29. The iron golf club head of claim 23, said first casing being a forged casing.

30. The iron golf club head of claim 29, said second casing being a cast casing.

31. The iron golf club head of claim 23, said first casing having an average hardness between HRC25–42.

32. The iron golf club head of claim 23, said first casing having an average hardness between HRB80–HRC20.

33. An iron golf club head having a hollow interior, a strike face, a hosel, a sole, a back side, a top line, a toe, and a heel, said iron golf club head comprising:

a first metal casing having said hosel and said strike face;

said strike face of said first metal casing comprising a center and an edge, said center of said strike face possessing a hardness that is different from the hardness of the edge of the strike face;

a second metal casing having a metallic wall that defines said sole, said back side, said top line, and a front side located opposite from said back side, said second casing having a first cavity as viewed from a direction facing said front side and a second cavity as viewed from a direction facing said back side, said first and second cavities extending in a direction from said heel to said toe, said first casing being welded to said second casing such that said first cavity defines at least a portion of said hollow interior of said iron golf club head.

34. The iron golf club head of claim 33, wherein the hardness of the center of the strike face is approximately HRC35 and the hardness of the edge of the strike face is about HRC25 said first casing having an average hardness between HRC25–42.

35. The iron golf club head of claim 33, wherein said first cavity is located above said second cavity as measured with respect to said sole.

36. Iron golf club heads, comprising:

a long metal iron head having a hollow interior, a strike face, a hosel, a sole, a back side, a top line, a toe, a heel, and a loft, said long metal iron head being formed from a first casing and a second casing, said first casing having said hosel and said strike face, said second casing having said sole, said back side, said top line, a front side located opposite from said back side, and a cavity as viewed from a direction facing said front side, said first casing being welded to said second casing such that said cavity defines at least a portion of said hollow interior; and a short metal iron head having a hollow interior, a strike face, a hosel, a sole, a back side, a top line, a toe, a heel, and a loft greater than the loft of the long metal iron, said short metal iron head being formed from a third casing and a fourth casing, said third casing having said hosel and said strike face of said short metal iron head, said fourth casing having said sole, said back side, and said top line of said short metal iron head, said fourth casing having a front side located opposite from said back side of said fourth casing, said fourth casing having a cavity as viewed from a direction facing said front side of said fourth casing, said third casing being welded to said fourth casing such that said cavity of said fourth casing defines at least a portion of said hollow interior of said short metal iron head, said strike face of said short metal iron head and said strike face of said long metal iron head being fabricated of different metal materials, and at least a center of said strike face of said long metal iron head being heat treated while said strike face of said short metal iron head is not heat treated so that said strike face of said long metal iron head possesses an average hardness greater than the average hardness of said strike face of said short metal iron head.

* * * * *